US005090709A

United States Patent [19]

Johnson

[11] Patent Number: 5,090,709

[45] Date of Patent: Feb. 25, 1992

[54] ARROWHEAD WITH EXTENDABLE BLADES

[76] Inventor: Gregory G. Johnson, 4824 Northrop Dr., Minneapolis, Minn. 55406

[21] Appl. No.: 540,143

[22] Filed: Jun. 19, 1990

[51] Int. Cl.[5] ..... F42B 6/08

[52] U.S. Cl. ..... 273/422

[58] Field of Search ..... 273/421, 422

[56] References Cited

U.S. PATENT DOCUMENTS

| | | | |
|---|---|---|---|
| 2,289,284 | 7/1942 | Chandler | 273/421 |
| 2,568,417 | 9/1951 | Steinbacher | 273/421 |
| 2,820,634 | 1/1958 | Vance | 273/421 |
| 3,036,396 | 5/1962 | Swails | 273/420 |
| 3,578,328 | 5/1971 | Rickey | 273/421 |
| 3,738,657 | 6/1973 | Cox | 273/421 |
| 4,099,720 | 7/1978 | Zeren | 273/422 |
| 4,537,404 | 8/1985 | Castellano et al. | 273/422 |
| 4,579,348 | 4/1986 | Jones | 273/421 |
| 4,615,529 | 10/1986 | Vocal | 273/421 |
| 4,807,889 | 2/1989 | Johnson | 273/422 |
| 4,940,246 | 7/1990 | Stagg | 273/421 |
| 4,976,443 | 12/1990 | DeLucia | 273/421 |

*Primary Examiner*—Paul E. Shapiro

*Attorney, Agent, or Firm*—Burd, Bartz & Gutenkauf

[57] ABSTRACT

An arrow has an arrowhead with fixed cutting blades and extendable blades located adjacent the fixed blades. The blades are mounted on a tubular body having longitudinal slots accommodating the blades. A nose attached to the forward end of the body retains the fixed blades on the body. Pins pivotally connect the extendable blades on the body. A ring releasably holds the extendable blades in the slots.

23 Claims, 3 Drawing Sheets

ARROWHEAD WITH EXTENDABLE BLADES

FIELD OF THE INVENTION

This invention relates to projectiles, such as arrows usable with large game bows having heads with a plurality of fixed blades and expandable blades.

BACKGROUND OF THE INVENTION

Conventional arrows have arrowheads with one or more fixed blades. The cutting ability of these arrows is limited which often results in a superficial wound or a wound causing the hunted game to slowly bleed to death or suffer. Also, conventional arrows have a tendency to pass through the game or other target resulting in lost arrows. The term "game" refers to wild animals, fowl and fish. Conventional arrows are not effective in hunting wild turkeys, as they pass through or remain in the turkeys without achieving execution. The wounded turkeys can survive a considerable period of time before death or prey of an animal.

Prior arrowheads have been provided with movable cutting blade structure that cooperates with one or more fixed blades to cut game or a target. For example, B. H. Steinbacher, in U.S. Pat. No. 2,568,417, discloses an arrowhead assembly having fixed blades and a pair of pivoting blades located between the fixed blades. The pivoting blades move in a rearward direction to an open position when the arrowhead enters the game or target. Additional hunting arrows having extendable cutting blades are shown by E. P. Cox in U.S. Pat. No. 3,738,657 and R. S. Vocal in U.S. Pat. No. 4,615,529.

SUMMARY OF THE INVENTION

The invention comprises an arrowhead for a target and hunting arrow that has a plurality of fixed first blades with front cutting edges and a plurality of pivoting second blades that move from a closed folded position to an open extended position as the arrowhead penetrates the target or game. The second blades increase the cutting action of the arrowhead and prevent the arrowhead from passing through the target or game. The combined cuts of the first and second blades cause rapid hemorrhaging of the game with quick death.

The arrowhead has a tubular body adapted to be connected to a shaft of an arrow. The body has longitudinal first slots accommodating the first blades. A nose mounted on the forward end of the body retains the first blades on the body. A plurality of longitudinal second slots extend into the body adjacent the first slots accommodate second blades. The first and second blades are flat knife blades located in close side-by-side relationships. Pins pivotally connect the second blades to the body to allow the second blades to swing rearwardly out of the second slots to extendable positions. The body has stops that are engaged by the second blades to limit the swinging of the second blades rearwardly to their full extended positions. An annular member, such as a resilient ring, surrounds the body to hold the second blades in the second slots.

In use, when the arrowhead hits the target or game, the nose and fixed first blades penetrate the surface of the target and cut slits therein. The forward ends of second blades then contact the target and swing rearwardly away from the body and penetrate the target. The forward motion and penetrate the target. The forward motion of the arrowhead causes the second blades to open to the full extended positions. The forward cutting edges of the second blades track the slits and increase the cutting of the target. The extended second blades also prevent the arrowhead from passing through the target or game.

The arrowhead is strong in construction with a light weight that does not alter the longitudinal or concentric balance of the arrow. The movable second blades are confined within the body of the arrowhead during the flight of the arrow so that they do not effect arrow flight or catch on twigs, branches, leaves, or like obstructions in the field.

DESCRIPTION OF THE PREFERRED EMBODIMENT

Figure 1:
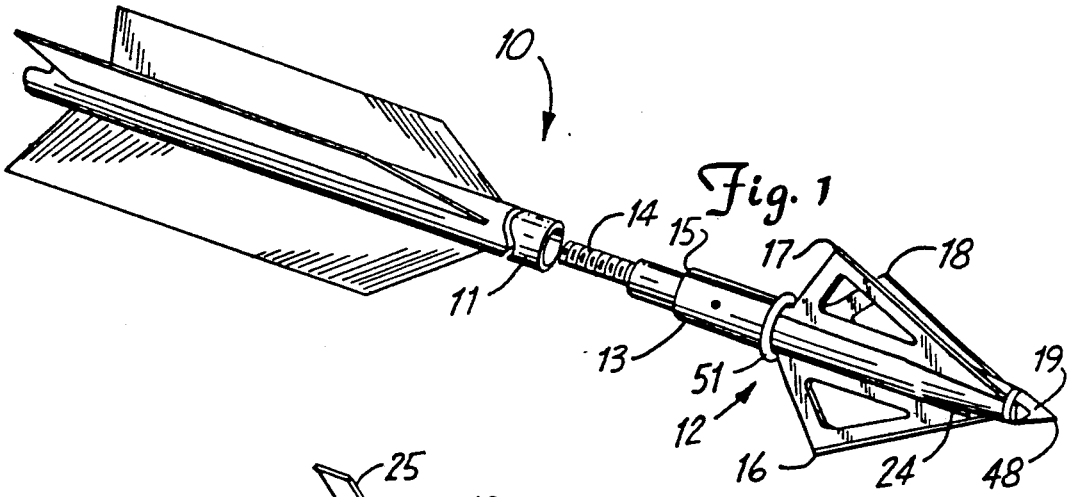
FIG. 1 is a foreshortened perspective view of an arrow equipped with the arrowhead of the invention showing the movable blades in the closed position adjacent the fixed blades.
Figure 2:
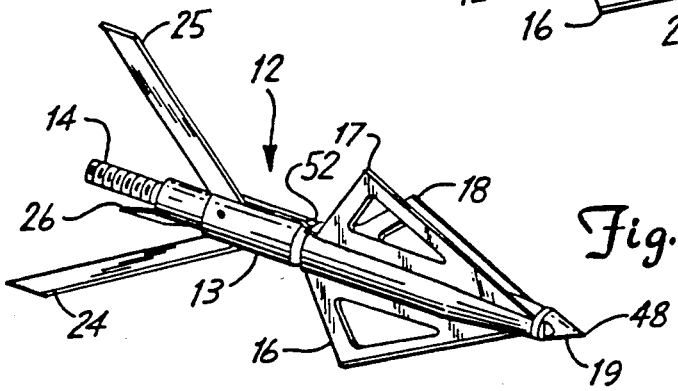
FIG. 2 is a perspective view of the arrowhead of the arrow of FIG. 1 showing the movable blades in the open position located rearwardly of the fixed blades.

Referring to FIGS. 1 and 2, there is shown an arrowhead of the invention indicated generally at 12 attached to a forward end of an arrow 10. Arrow 10 is used for target shooting or large game hunting. The term "game" refers to animals, fowl and fish including, but not limited to, deer, elk, bear, moose, fox, rabbits, coyote, turkey and rodents. Arrowhead 12 causes more rapid hemorrhaging of the game resulting in quicker death than a conventional hunting arrowhead. Arrowhead 12 also prevents arrow 10 from passing through the target or game minimizing arrow loss and wounded game.

Arrow 10 has an elongated tubular shaft 11 attached to arrowhead 12. Shaft 11 is an elongated metal or plastic tubular structure that has threads at the forward end thereof. Arrowhead 12 has a cylindrical tubular body 13 with a threaded rear end 14 that is attached to the forward end of shaft 11. Body 13 is an elongated metal tube that is rotated relative to shaft 11 to remove arrowhead 13 from shaft 11. Body 13 has an annular shoulder 15 that engages the forward end of shaft 11 to hold arrowhead 12 securely on shaft 11. The forward end 13A of body 13 is tapered inwardly and attached to a conical-shaped nose 19. Nose 19 has a rearwardly extended threaded end 20 that is accommodated by a threaded bore in the forward end of body 13, as shown in FIGS.

5, 6 and 11. The outside surface of nose 19 tapers forwardly to a point 48. The surfaces have opposite flats for accommodating a tool used to turn end 20 into body 13.

Figure 3:
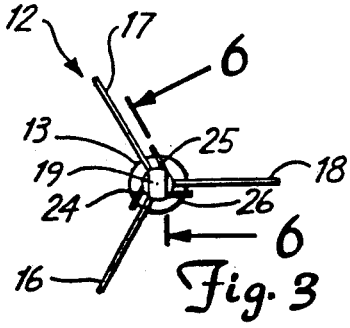
FIG. 3 is a front view of the arrowhead of FIG. 1.
Figure 4:
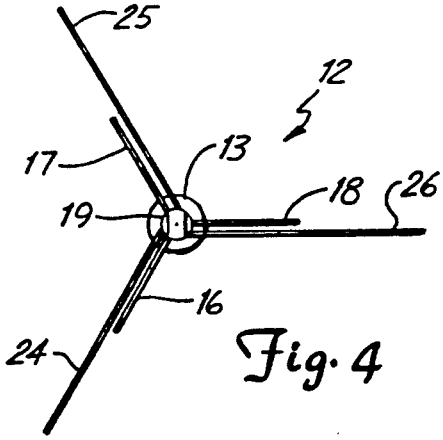
FIG. 4 is a front view of the arrowhead of FIG. 2.

A plurality of fixed blades or knives 16, 17 and 18 are secured to body 13. Each blade 16, 17, 18 has a generally triangular shape with a forward knife edge 16A, 17A, 18A that tapers downwardly and inwardly toward nose 19 of body 13. As shown in FIGS. 3 and 4, three blades 16, 17 and 18 are circumferentially spaced apart about 120 degrees and project radially outwardly from body 13. Blades 16, 17 and 18 circumferentially balance the arrowhead so they are identical in structure and are located in radial planes that intersect at the center of body 13. Arrowhead 12 can also have other blade arrangements and structures. The longitudinal inner edges of blades 16, 17 and 18 extend into longitudinal grooves or first slots 37, 38 and 39 in body 13 and are mounted on body 13, as seen in FIG. 14. Blade 17 has an inwardly directed tab 41 extended through a slot 42 in body 13 at the rear end of groove 38. Tab 41 has a short projection or hook 43 that extends rearwardly in the passage of body 13. Projection 43 engages the inner surface of body 13 to hold blade 17 in groove 37. The forward end 44 of blade 17 fits under an annular skirt 46 of nose 18. Skirt 46 surrounds an annular pocket 47 accommodating the forward end 13A of body 13 and the forward end of blade 17. Blades 16 and 18 are identical to blade 17. Pocket 47 is an annular recess concentric with the longitudinal axis of nose point 48 for the forward ends of blades 16, 17 and 18. Nose 18, when connected to body 13 in conjunction with the tabs 41 and projections 43, holds blades 16, 17 and 18 in fixed positions on body 13. Blades 16, 17 and 18 can be removed from body 13 by turning nose 19 off body 13. Each blade can then be pivoted upward out of grooves 37, 38 and 39 and extracted from body 13. New blades can be then be mounted on body 13 by inserting tab 41 through slot 42 and moving the blade 17 down into groove 37. Nose 19 turned onto body 13 holds the forward ends of the blades on body 13.

Figure 10:
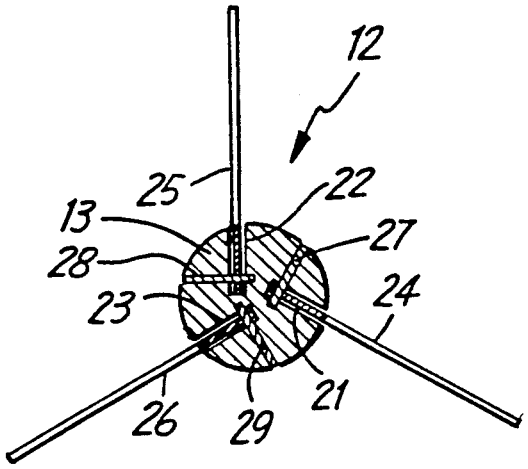
FIG. 10 is an enlarged sectional view taken along line 9—9 of FIG. 6.
Figure 7:
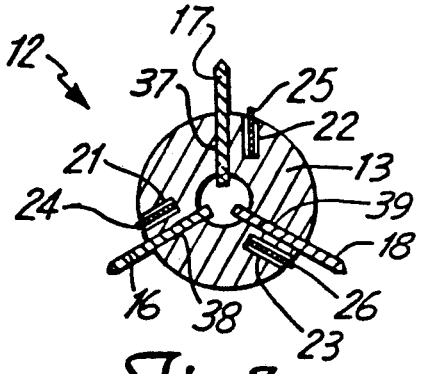
FIG. 7 is an enlarged sectional view taken along the line 7—7 of FIG. 5.
Figure 8:
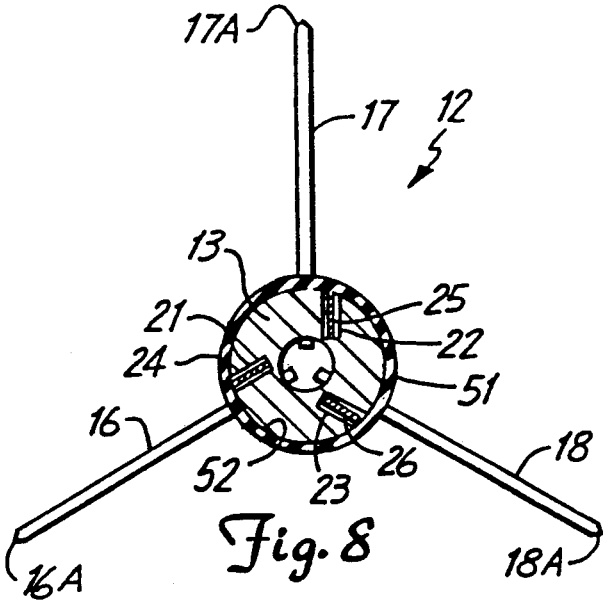
FIG. 8 is an enlarged sectional view taken along line 8—8 of FIG. 5.

Referring to FIGS. 7 and 8, body 13 has a plurality of elongated, generally longitudinal second slots 21, 22 and 23 that extend adjacent fixed blades 16, 17 and 18. Slots 21, 22 and 23 are parallel to fixed blades 16, 17 and 18 and extend from the forward end of body 13 to the back end of body 13 adjacent shoulder 15. Slots 21, 22 and 23 extend along chord planes parallel to the radial planes of grooves 37, 38 and 39. The slots 21, 22 and 23 and grooves 37, 38 and 39 are in close side-by-side relationship to locate the adjacent just and second blades close to each other. Each slot 21, 22 and 23 accommodates a movable or pivoting blade 24, 25 and 26. The number of slots and pivoting blades corresponds to the number of fixed blades of arrowhead 12. Preferably, arrowhead 12 has three slots 21, 22 and 23 accommodating three pivoting blades 24, 25 and 26 adjacent fixed blades 16, 17 and 18. The rear end of each blade 24, 25, 26 is pivoted to body 13 with a bolt or pin 27, 28, 29, as seen in FIG. 10. Pins 27, 28 and 29 are located in bores in body 13 and extend through holes adjacent the rear ends of blades 24, 25 and 26. Pins 27, 28 and 29 are located normal to blades 24, 25 and 26 allowing the blades 24, 25 and 26 to swing or, as shown by arrow 48, pivot between a closed or folded position and an open or extended position. Blades 24, 25 and 26 have rounded rear ends allowing the blades to pivot in slots 21, 22 and 23. Blades 24, 25 and 26 engage the back walls of slots 21, 22 and 23 when the blades are in the extended position. The back walls of slots 21, 22 and 23 function as stops limiting backward movement of blades 24, 25 and 26. Blades 24, 25 and 26 have a close fit within slots 21, 22 and 23 when the blades are in the closed position. Each blade 24, 25 and 26 is free to pivot to its open position as the arrowhead moves into the target or game.

Figure 11:
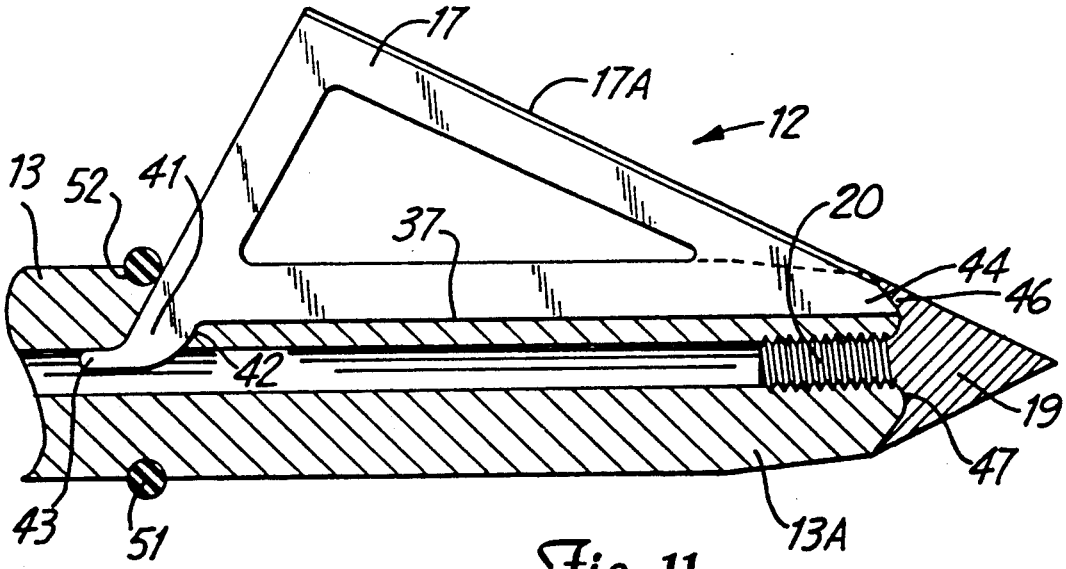
FIG. 11 is an enlarged sectional view similar to FIG. 5.
Figure 5:
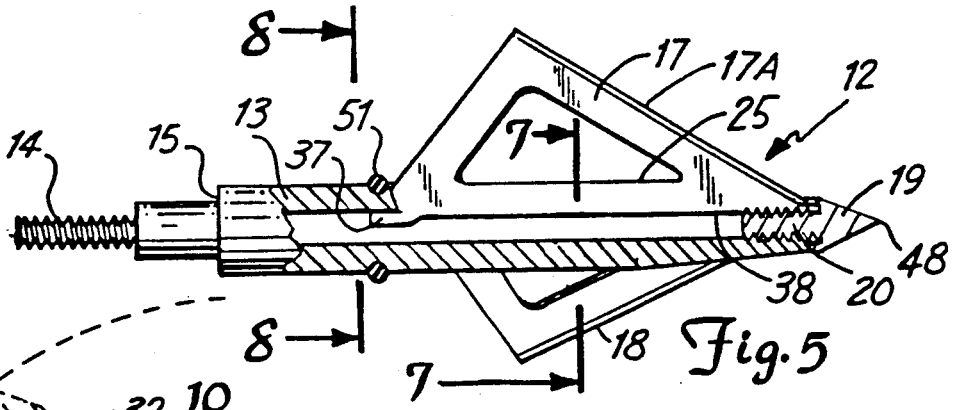
FIG. 5 is a side view partly sectioned of the arrowhead of FIG. 1.
Figure 6:
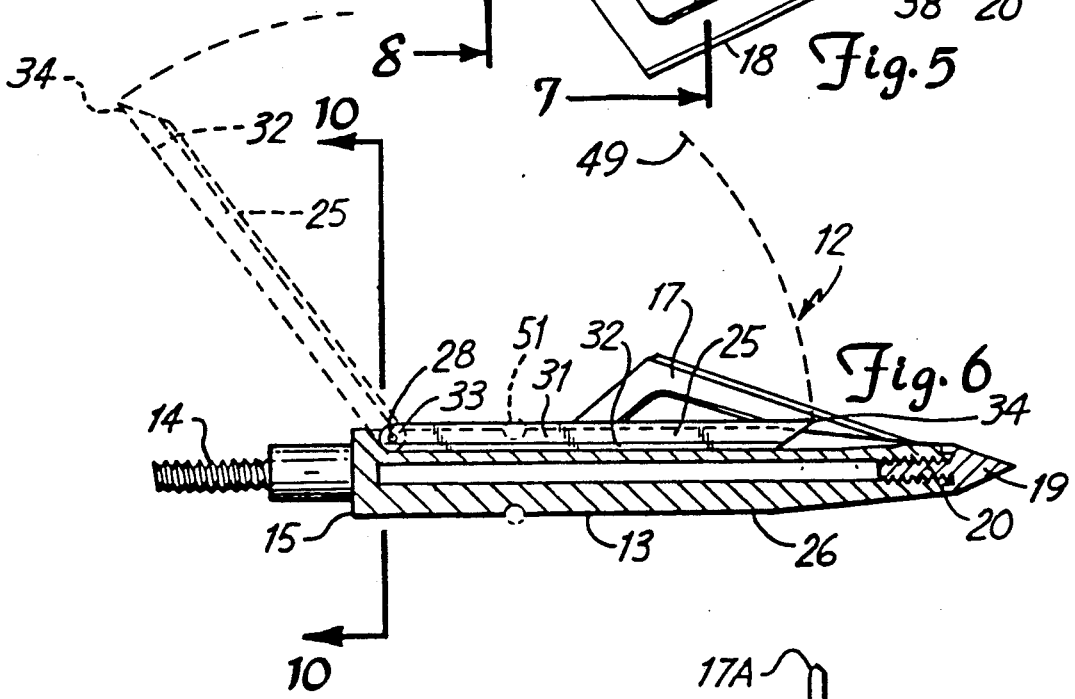
FIG. 6 is an enlarged sectional view taken along line 6—6 of FIG. 3 showing a movable blade in full lines in the open position and in broken lines in the closed position.
Figure 9:
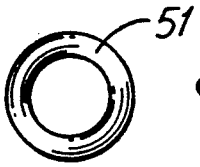
FIG. 9 is a perspective view of the annular holders for the movable blades.

Referring to FIG. 6, pivoting blade 25 has a generally flat plate 31 with a knife edge 32 on its forward side. When plate 31 is in the extended position, knife edge 32 extends outwardly and rearwardly. Knife edge 32 can be at a 45-degree angle relative to the axis of body 13. The rear portion of plate 31 has a hole 33 for accommodating pin 28, as seen in FIG. 10. Returning to FIG. 6, plate 31 has a rounded rear end allowing the plate to pivot in slot 22. The rear portion of plate 31 engages the back wall of slot 22 when blade 25 is in the extended position. This stops the backward movement of blade 25. Plate 31 has a generally triangular shaped head 34 with a flat front face 36. Head 34 projects outwardly and forwardly from the tapered front portion of body 13. As seen in FIG. 6 and 11, the forward point 34 of blade 25 is behind or rearwardly of the cutting edge 17A of fixed blade 17. The back side of plate 31 is below the outer surface of body 13 rearwardly of the tapered front portion of body 13 when blade 25 is in the closed position. Plate 31 is held in slot 22 with a ring or annular member 51. As shown in FIG. 9, ring 51 is an elastic band or O-Ring of resilient material, such as rubber or plastic, that is expanded over the inner end of body 13 so it has an inner diameter smaller than the diameter of body 13. As seen in FIG. 11, body 13 has an annular groove 52 adjacent the back portions of fixed blades 16, 17 and 18 for accommodating ring 52. In use, ring 51 holds blades 24, 25 and 26 in slots 21, 22 and 23 as shown in FIG. 8. The forward end 34 of each blade 21, 22 and 23 is located rearwardly of the cutting edges of the fixed blades 16, 17 and 18 to allow the fixed blades to cut and enter the target before the movable blades 24, 25 and 26 pivot to their open positions. When blades 24, 25 and 26 pivot open ring 51 expands and breaks thereby allowing blades 24, 25 and 26 to move to their full open positions as shown in FIG. 4. Pivoting blades 24 and 26 are identical in structure and function to blade 25.

In use, pivoting blades 24, 25 and 26 are moved to their closed position by locating them into slots 21, 22 and 23. Ring 51 is slipped over the rear end of body 13 and located in annular groove 52 so that blades 24, 25 and 26 are held in body 13 during the shooting of arrow 10. Heads 34 of blades 24, 25 and 26 extend outwardly and rearwardly from the front portion of body 13 when the blades are in their folded position. When arrow 10 hits the target or animal nose 19 and the front portions of fixed blades 16, 17 and 18 will first penetrate the surface of the target and cut slits therein. Flat front faces 36 of pivoting blades 24, 25 and 26 will then engage the surface of the target. The forward force of arrow 10 will cause blades 24, 25 and 26 to track the slits made by blades 16, 17 and 18 and pivot outwardly and rearwardly to their expanded position, as shown in FIGS. 2 and 4, exposing knife edges 32. The rear portions of blades 24, 25 and 26 engage the back walls of slots 21, 22 and 23 to hold the blades in their expanded position. Knife edges 32 additionally cut the target or the game as the arrowhead moves into the target. The additional cutting of the game increases hemorrhaging of the game, resulting in a quick, humane death. The spread blades 24, 25 and 26 also will prevent arrow 10 from passing through the target or game thereby minimizing arrow loss. Pivoting blades 24, 25 and 26 cut along planes that are adjacent and parallel to the cutting planes of fixed blades 16, 17 and 18. When removing arrow 10 from the target or game, blades 24, 25 and 26 pivot inwardly and forwardly. This facilitates removal of arrow 10 from the target or game.

While there has been shown and described a preferred embodiment of the arrowhead with extendable blades, it is understood that changes in materials, size, shape, and arrangement of structure may be made by those skilled in the art without departing from the invention. The invention is defined in the following claims.

I claim:

1. An arrowhead assembly attachable to an arrow comprising: an elongated generally cylindrical body having a longitudinal axis and an inwardly tapered forward end, a plurality of fixed first blade means mounted on the body generally parallel to the longitudinal axis of the body, said first blade means having forward knife edges for cutting an object, and rear portions mounted on the body, a plurality of second blade means having forward heads and knife edges for cutting the object, said body having longitudinal slot means with forward ends open to the tapered forward end of the body and closed rear ends for accommodating the second blade means adjacent and parallel to one side of each first blade means and stops at the rear ends of the slot means, said second blade means being selectively movable from a folded position in the slot means to an extended position outwardly from the body, said second blade means engageable with the stops when located in their extended positions, said second blade means having the knife edges located in said slot means and the forward heads spaced outwardly from said tapered forward end of the body when the second blade means are in the folded position, pivot means pivotally mounting the second blade means on the body adjacent the stops whereby the second blade means pivot from the folded position with the knife edges in the slot means to the extended position into engagement with the stops with the knife edges extended outwardly from the body when the body and first and second blade means enter the object, and reacting means releasably holding the second blade means in the folded position, said retaining means including a continuous annular member surrounding the second blade means and body forwardly of the pivot means adjacent the rear portions of the first blade means for holding the second blade means in the folded position, said annular member being severed when the second blade means pivots from the folded position to the extended position.

2. The assembly of claim 1 wherein: the fixed first blade means have outwardly and rearwardly directed cutting edges, said forward head of the second blade means being located rearwardly of the cutting edge of an adjacent fixed first blade means when the second blade means is in the folded position.

3. The assembly of claim 1 wherein: the slot means comprises a plurality of circumferentially spaced longitudinal slots provided in the body, each slot accommodating one second blade means.

4. The assembly of claim 1 wherein: the fixed first blade means comprises a plurality of generally triangular fixed blades having side portions secured to the body, the second blade means comprising a plurality of flat blades accommodated by the slot means and located adjacent side portions of the fixed blades.

5. The assembly of claim 4 wherein: the slot means comprises a plurality of elongated slots in the body extended adjacent the fixed blades.

6. The assembly of claim 1 wherein: the stops on the body are back walls engageable with the second blade means when the second blade means are in the extended position.

7. The assembly of claim 1 wherein: the body has an annular groove accommodating the annular member.

8. The assembly of claim 7 wherein: the annular member is a resilient ring located in said annular groove.

9. The assembly of claim 1 wherein: the pivot means pivotally mounting the second blade means on the body includes a plurality of pins extending into the body, the second blade means comprising a plurality of generally flat blades, each blade having a rear portion with a hold accommodating one of the pins.

10. An arrowhead assembly attachable to an arrow having arrow shaft comprising: a body having an inwardly tapered forward end and a rear end, a nose mounted on the forward end, the rear end having a threaded end portion adapted to be threaded on a front end of the arrow shaft, first blade means comprising a plurality of fixed longitudinal blades secured to the body having knife edges for cutting an object and rear end portions mounted on the body, the body having a plurality of elongated longitudinal slots having forward ends open to the forward end thereof and rear ends, and stops at the rear ends of the slots, each slot extending adjacent one side of the fixed blades, second blade means having forward heads and knife edges for cutting the object, said second blade means being selectively movable from a folded position in the slots to an extended position in engagement with the stops and projected outwardly from the body, said second blade means having the knife edges located in said slots and the forward heads spaced outwardly from said forward end of the body when the second blade means is in the folded position, pivot means pivotally mounting the second blade means on the body whereby when the second blade means pivot from the folded position with the knife edges in the slots to an extended position in engagement with the stops with the knife edges extended outwardly from the body the body and first and second blade means enter the object, and continuous annular retaining means surrounding the second blade means and body forwardly of the pivot means adjacent the rear portions of the first blade means releasably holding the second blade means in said slots, said annular means being severed when the second blade means pivot from the folded position to the extended position.

11. The assembly of claim 10 wherein: the second blade means comprises a plurality of generally flat blades, each head extending outwardly from the body when the flat blade is in the closed position.

12. The assembly of claim 10 wherein: the pivot means pivotally mounting the second blade means includes a plurality of pins extending into the body, the second blade means comprising a plurality of flat blades, each flat blade having a rear portion with a hole accommodating one of the pins.

13. The assembly of claim 12 wherein: each flat blade had a rounded rear edge allowing the flat blade to pivot about the pin in one of the slots to the extended position.

14. The assembly of claim 10 wherein: each stop is a back wall engageable with the flat blade when the flat blade is in the extended position.

15. The assembly of claim 10 wherein: the fixed blades are circumferentially spaced on the body and project radially outwardly from the body.

16. The assembly of claim 10 wherein: the body has an annular groove accommodating the annular member.

17. The assembly of claim 16 wherein: the annular means is a resilient ring.

18. An arrowhead assembly attachable to an arrow comprising: an elongated body having an outer surface, a longitudinal dimension, and an inwardly tapered forward end, a plurality of longitudinal slots having forward and rear ends located in said body open to the outer surface and a tapered forward end thereof, said body having stops at the rear ends of the slots, a plurality of blades having forward heads and knife edges for cutting an object, said blades being selectively movable from a folded position in the slot means to an extended position in engagement with the stops outwardly from the body, said blades having the knife edges located in said slot means and the forward heads spaced outwardly from said forward end of the body when the blades are in the folded position, pivot means pivotally mounting the blades on the body adjacent the stops whereby the blades pivot from the folded position with knife edges in the slots to the extended position in engagement with the stops with the knife edges extended outwardly from the body when the body and blades enter the object, and continuous annular retaining means surrounding the blades and body forwardly of the pivot means releasably holding the blades in said slots, said annular means being severed when the blades pivot from the folded position to the extended position.

19. The assembly of claim 18 wherein: the slots are circumferentially spaced about the body, each stop having a back wall engageable with a blade when the blade is in the extended position.

20. The assembly of claim 18 wherein: the body has an annular groove forwardly of the pivot means accommodating the annular retaining means.

21. The assembly of claim 20 wherein: the annular retaining means is a resilient ring located in said annular groove.

22. The assembly of claim 18 wherein: the pivot means includes a plurality of pins extended into the body across the slots, said blades having rear portions with holes accommodating said pins.

23. The assembly of claim 22 wherein: each blade has a rounded rear edge adjacent the hold to permit pivotal movement of the blade relative to body.

* * * * *